US007584953B2

(12) United States Patent
Johnson et al.

(10) Patent No.: US 7,584,953 B2
(45) Date of Patent: Sep. 8, 2009

(54) STEP SPRING AUTO-COMPENSATOR MECHANISM

(75) Inventors: Kevin Matthew Johnson, Georgetown, KY (US); Michael William Lawrence, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 252 days.

(21) Appl. No.: 11/561,129

(22) Filed: Nov. 17, 2006

(65) Prior Publication Data

US 2008/0116627 A1 May 22, 2008

(51) Int. Cl.
*B65H 3/06* (2006.01)

(52) U.S. Cl. ..... 271/117; 271/118

(58) Field of Classification Search ..... 271/117, 271/118

See application file for complete search history.

(56) References Cited

U.S. PATENT DOCUMENTS

| | | | | |
|---|---|---|---|---|
| 5,527,026 | A | 6/1996 | Padget et al. | |
| 5,927,703 | A * | 7/1999 | Endo | 271/10.03 |
| 7,059,596 | B2 * | 6/2006 | Iwase | 271/114 |
| 2004/0245704 | A1 * | 12/2004 | Hall et al. | 271/117 |
| 2005/0110206 | A1 * | 5/2005 | Hsieh | 271/117 |

* cited by examiner

*Primary Examiner*—David H Bollinger
(74) *Attorney, Agent, or Firm*—Middleton Reutlinger

(57) ABSTRACT

A media pick assembly has a media tray for retaining a stack of media in a peripheral device, an auto-compensating mechanism disposed adjacent to the media tray, the auto-compensating mechanism movable through an operating range including a starting angular position and an ending angular position, and a media biasing member engaging the auto-compensating mechanism and providing a discontinuous force on the auto-compensating mechanism through the operating range.

24 Claims, 10 Drawing Sheets

STEP SPRING AUTO-COMPENSATOR MECHANISM

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention provides a media feeding apparatus. More specifically, the present invention provides an auto-compensating mechanism in combination with a step-spring for providing appropriate normal force throughout the feeding of a media stack.

2. Description of the Related Art

Various mechanisms have been utilized to feed media into a printer or other peripheral. Various of these mechanisms utilize a tray or bin in order to support a stack media in which the upper most sheet of the stack may be advanced to a processing station or printing area for printing by a laser printer or inkjet printer, for example. In typical printing or duplicating devices, individual sheets of print media are advanced from the media tray to the processing station by utilizing a paper picking device.

With media picking devices a critical relationship exists between the pick roller and the media stack. More specifically the relationship involves a normal force between the pick roller and the media stack. The normal force must be within an operating range for the pick or media feed process to work properly. When too much normal force exists, multiple sheet of media may be fed resulting in paper jams. When too little normal force exists, media will not feed into the printing area. Some devices utilize a spring loaded paper stack to provide the normal force for picking. Despite extensive tuning of this normal force, usually only a very narrow range of media weights will run reliably on these devices.

Feeding of print media sheets from a stack has been significantly improved by an auto-compensating mechanism (ACM) shown and described in U.S. Pat. No. 5,527,026, issued to Padget et al. which overcomes problems with obtaining proper normal force. Auto-compensating media feeders address prior art issues in media feeding. A pick roll is mounted on the rotating swing arm and rests on the media stack. When the pick roll drive gear is initiated through a gear located on the pivot shaft with the swing arm, a torque is applied to the swing-arm through a gear transmission. The torque rotates the swing arm and pick roll into the media stack. This generates a normal force which is dictated by the buckling resistance of the media being picked. The normal force is no more than is required to buckle a single sheet of media plus the friction resistance between the first and second sheets. When the upper most sheet has moved, the normal force automatically relaxes and, thus, the auto-compensating mechanism will not deliver more normal force than what is required to feed a single sheet of media.

In a C-path feeding system, the ACM is disposed in a generally horizontal position when the media tray contains a full stack of media at upper positions, close to the horizontal, the down force created by the ACM is not high enough to consistently feed the microporous media because the normal force provided by the ACM is low. As the media stack height decreases during operation, the ACM moves through its operating positions during which time the normal force increases. At lower positions, i.e. positions away from the horizontal, the down force is high enough to allow for sheet feeding of the microporous media and the like. These systems are critically affected by various media characteristics including, but not limited to, density, net weight, stiffness and smoothness of the media surface. For example, lightweight media is fairly easy to move from a media stack. However, as media thickness and weight have increased with increased photo printing, the difficulty with consistent feeding throughout a media stack has increased. Even more recently, print feeding difficulties have occurred due to the use of microporous photo paper. The high coefficient of friction between sheets of microporous media tends to remove the ACM from its range of operating torque. Increased down force of the ACM has not alleviated this problem throughout the media stack feeding.

Given the foregoing deficiencies, it will be appreciated that an apparatus is needed which allows consistent media feeding of many types of media.

SUMMARY OF THE INVENTION

A media pick assembly comprises a media tray for retaining a stack of media in a peripheral, an auto-compensating mechanism disposed adjacent to the media tray, the auto-compensating mechanism movable through an operating range including a starting angular position and an ending angular position, and a media biasing member engaging the auto-compensating mechanism and providing a discontinuous force on the auto-compensating mechanism through the operating range. The discontinuous force may act on the auto-compensating mechanism based on a position of the auto-compensating mechanism. The down force is applied in a limited portion of the operating range corresponding to a height of the stack of media in the media tray. The biasing member disengages the auto-compensating mechanism at a preselected position. The limited angular range is between about 0 degrees and about 25 degrees. The biasing member is a leaf spring or a coil spring. The assembly has a total down force by the auto-compensating mechanism and the discontinuous force by the biasing member is between about 2 and 4 milli-newtons. One end of the biasing member is connected to a structure inside of the peripheral. One end of the biasing member is connected to or in contact with the auto-compensating mechanism.

A media pick assembly comprises a printer, an auto-compensating mechanism within the printer which transmits torque to a media pick tire, the auto-compensating mechanism increasing down force on a media stack during operation through a preselected angular range, a biasing member having a first end and a second end, the first end engaging a stationary part of the printer, the second end engaging the auto-compensating mechanism, the biasing member applying a discontinuous force to the auto-compensating mechanism through a limited portion of the preselected angular range. The auto-compensating mechanism moves from a substantially horizontal position downward to a lower limit during the preselected angular range. The auto-compensating mechanism creates a down force which is proportional to resistance created between media sheets, the down force being greater when the media stack is low than when the media stack is high. The biasing member engages the auto-compensating mechanism when the media stack is high or above a preselected height to increase down force in the limited portion of the preselected angular range. The biasing member is connected to or engages with the auto-compensating mechanism. The biasing member is connected to an internal portion of the printer.

A media pick biasing assembly for a peripheral having an auto-compensating mechanism comprises an auto-compensating mechanism rotatably connected to a drive shaft, the auto-compensating mechanism having a range of motion associated with feeding of media from a media tray in the peripheral, a biasing member connected to the peripheral and engaging the auto-compensating mechanism, the biasing member applying a force on the auto-compensating mechanism through a preselected angular range of motion of the auto-compensating mechanism. The auto-compensating mechanism moving from a first position to a second position. The biasing member engages the auto-compensating mechanism within the preselected range of motion between the first position and the second position. The preselected range of motion is about 0 degrees to about 25 degrees. The biasing member is one of a leaf spring and a coil spring. The biasing member creates additional downward force for the auto-compensating mechanism within the preselected range and additional downward force is inhibited outside the preselected angular range.

A method of feeding media from a media stack into a peripheral device using an auto-compensating device, comprises applying a discontinuous force on said auto-compensating mechanism when said media stack is above a preselected height; feeding media from said input tray with said auto-compensating device; and discontinuing applying said discontinuous force on said auto-compensating mechanism when said media stack decreases to said preselected height during feeding of said media.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
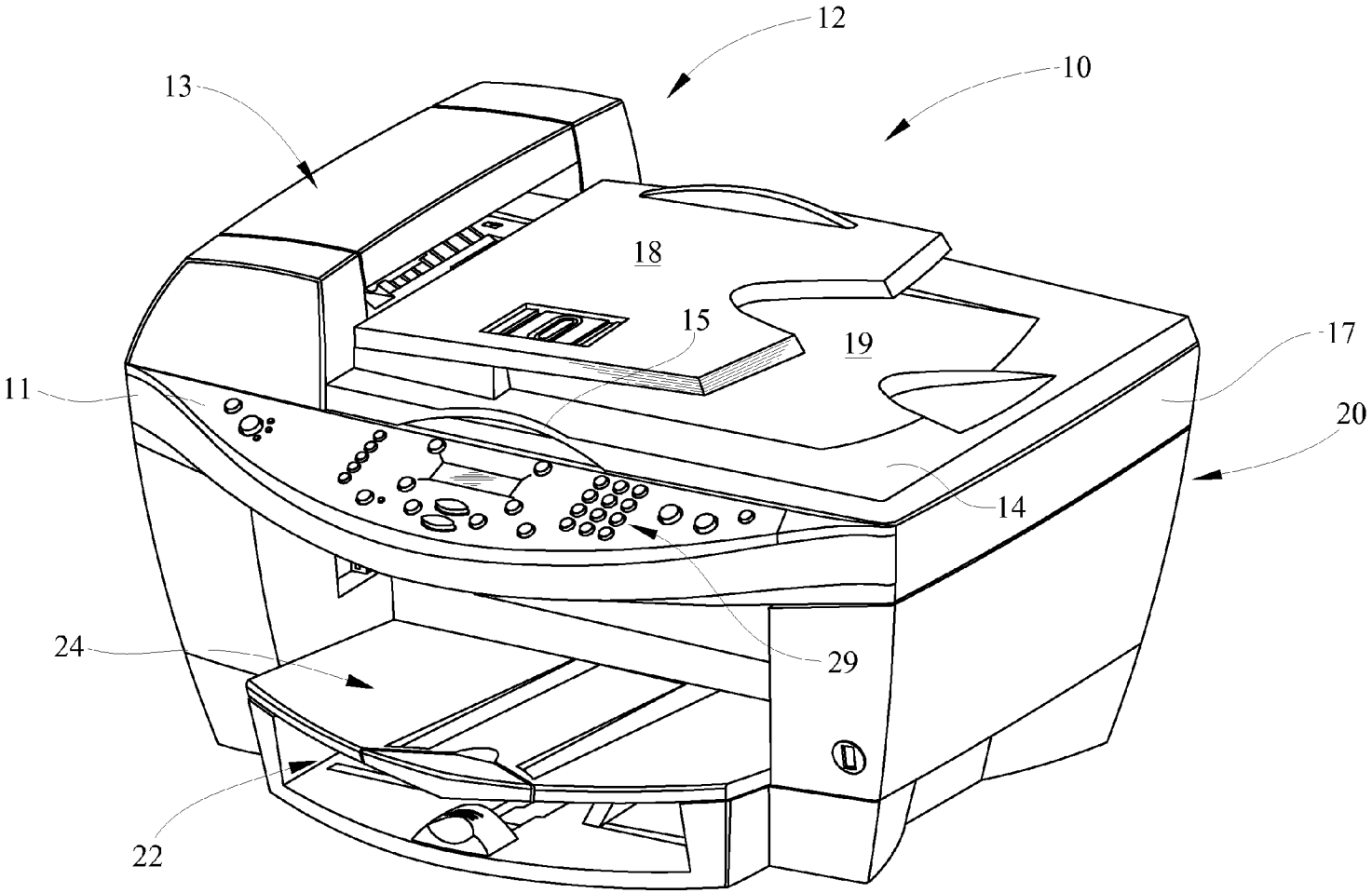
FIG. 1 is a perspective view of an exemplary multi-function peripheral.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate multiple functions such as scanning, copying, and printing capabilities in one device. Such printing devices may utilize ink jet, dot matrix, dye sublimation, laser, and any other suitable print formats. The term button as used herein means any component, whether a physical component or graphic user interface icon, that is engaged to initiate output.

Referring now in detail to the drawings, wherein like numerals indicate like elements throughout the several views, there are shown in FIGS. 1-10 various aspects of a peripheral device. The apparatus provides a step spring in combination with an ACM for consistent feeding of multiple media types through various media stack heights consistent with feeding of the stack from a media tray during printing.

Referring initially to FIG. 1, an all-in-one device 10 is shown having an ADF scanner portion 12 and a printer portion 20, depicted generally by the housing. The all-in-one device 10 is shown and described herein, however one of ordinary skill in the art will understand upon reading of the instant specification that the present invention may be utilized with a stand alone printer, copier, scanner or other peripheral device utilizing a media feed system. The peripheral device 10 further comprises a control panel 11 having a plurality of buttons 29 for making command selections or correction of error conditions. The control panel 11 may include a graphics display to provide a user with menus, choices or errors occurring with the system.

Figure 2:
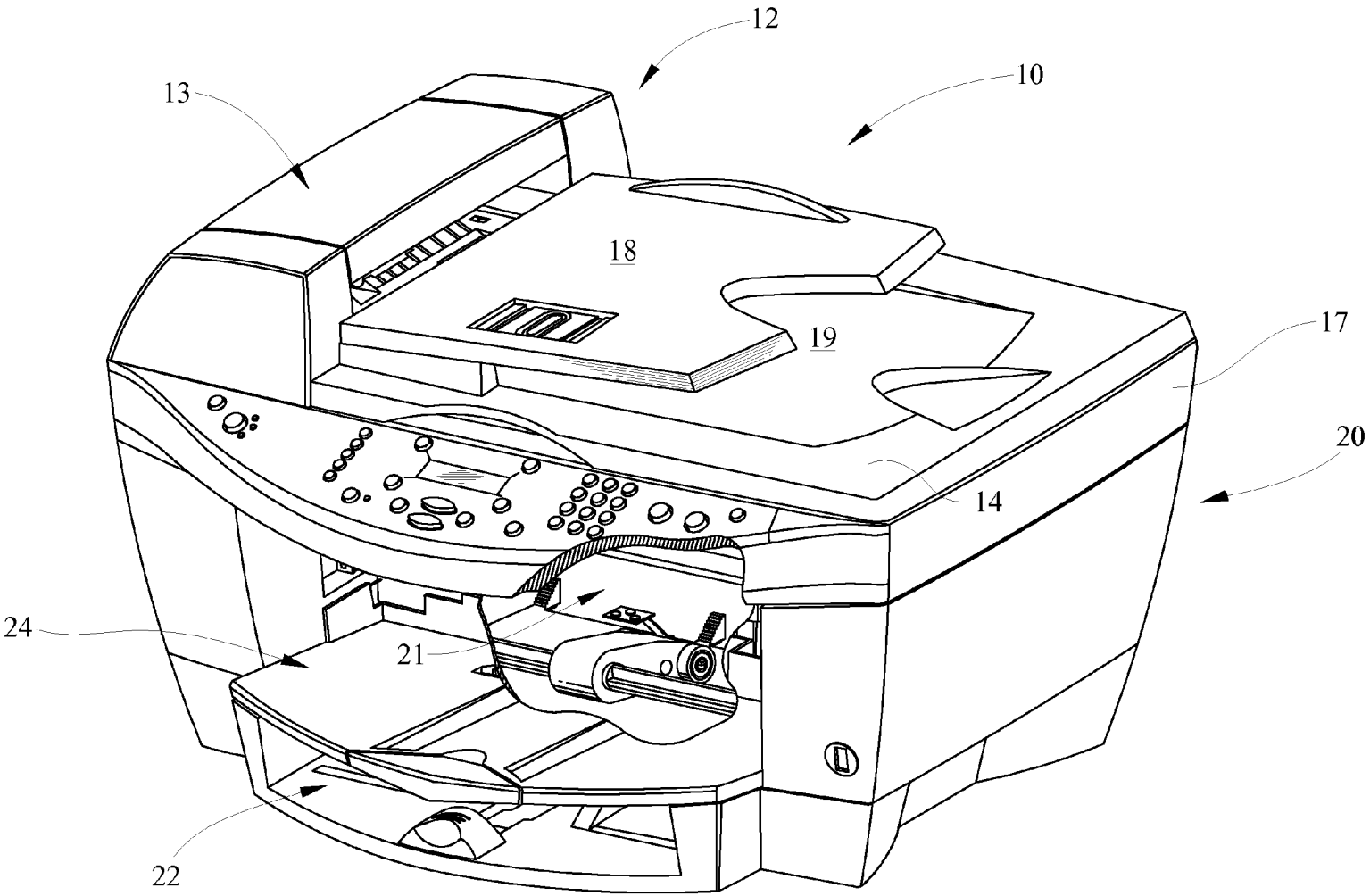
FIG. 2 is a perspective view of the exemplary multi-function peripheral of FIG. 1 with a cut-away portion.
Figure 3:
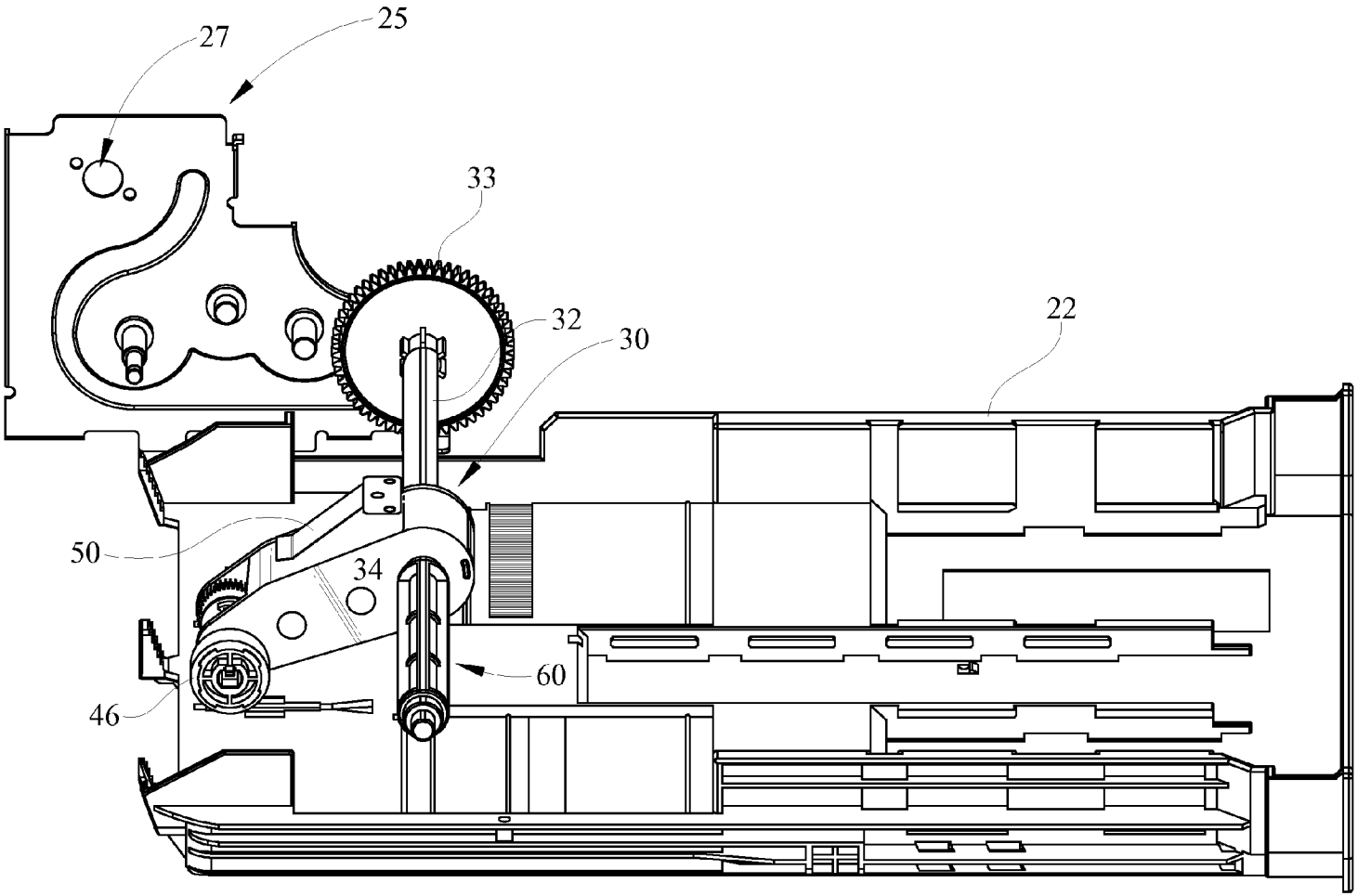
FIG. 3 is a perspective view of the ACM with a step-spring.

Referring to FIGS. 1 and 2, extending from the printer portion 20 is an input tray 22 and an exit tray 24 at the front of the device 10 for retaining media before and after a print process, respectively. The input and output trays 22, 24 of the printer portion 20 define start and end positions of a media feedpath 21 (FIG. 2). The media trays 22, 24 each retain a preselected number of sheets defining a stack of media (not shown) which will vary in height based on the media type. One skilled in the art will understand that the media feedpath 21 is a C-path media feed due to the depicted configuration.

Figure 6:
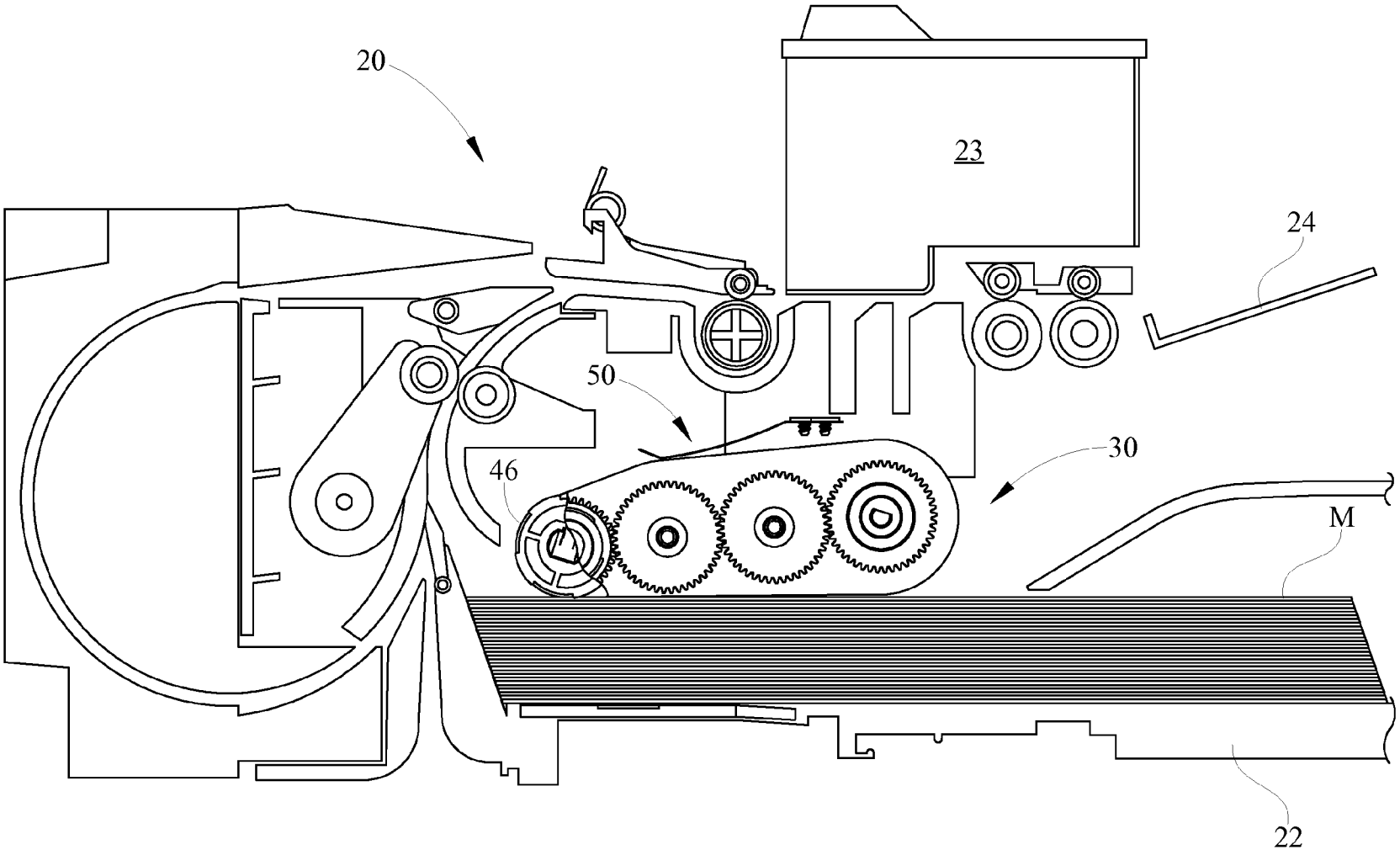
FIG. 6 is a side view of the media tray within the printer and the positioning of the ACM and multi-step spring with a full media stack.
Figure 7:
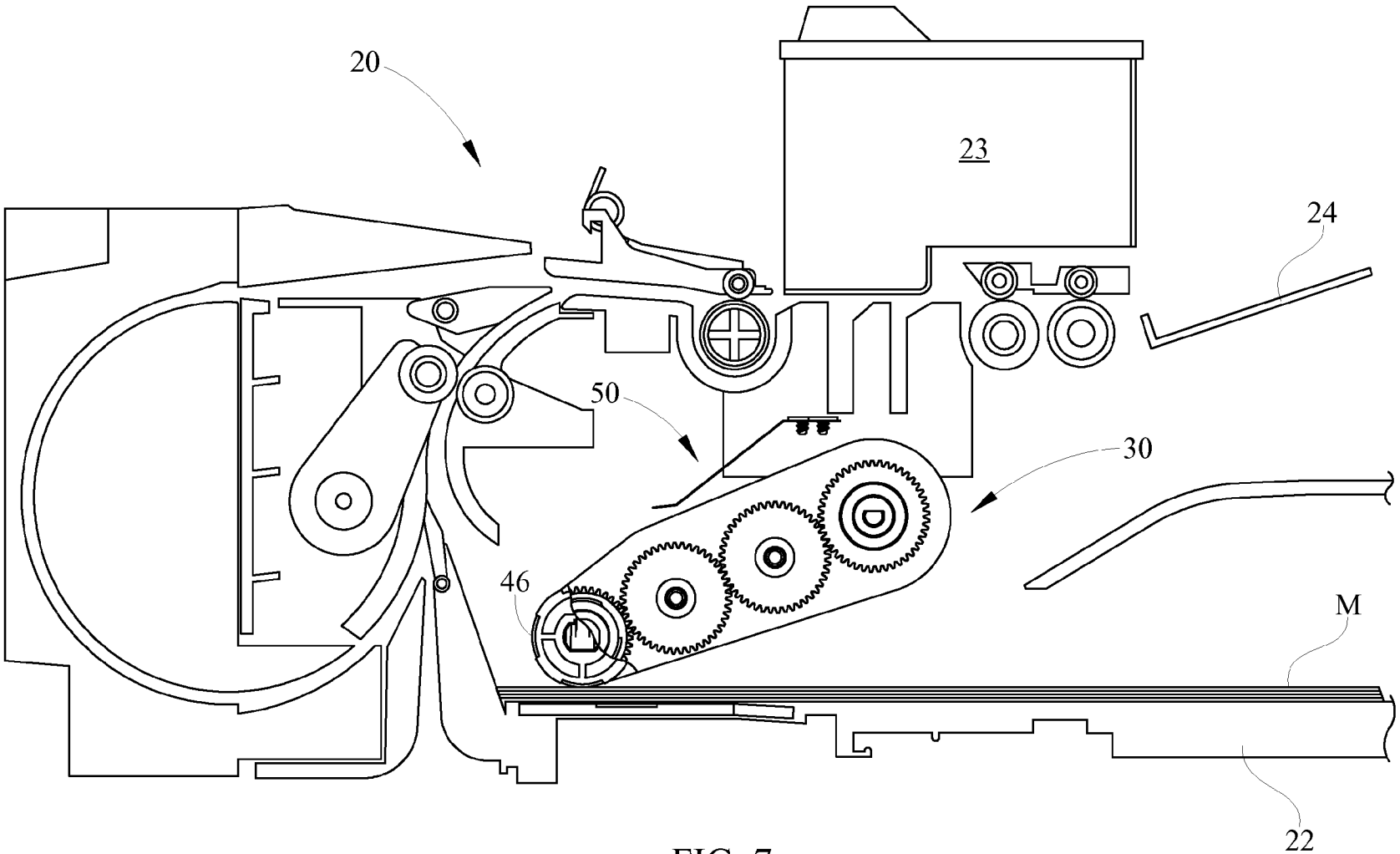
FIG. 7 is a side view of the media tray within the printer and positioning of the ACM and multi-step spring with a nearly empty media stack.

Referring now to FIG. 2, an interior cut-away perspective view of the all-in-one device 10 is depicted. The printer portion 20 may include various types of printing mechanisms including dye-sublimation, ink-jet printing mechanism or laser printing. For purpose of clarity, the printing components are not shown in FIG. 2, so that the ACM and step-spring arrangement are clearly depicted. For ease of description, the exemplary printer portion 20 is an inkjet printing device. With the interior shown, the printing portion 20 may include a carriage (not shown) having a position for placement of at least one print cartridge 23 (FIGS. 6, 7). In the situation where two print cartridges are utilized, for instance, a color cartridge for photos and a black cartridge for text printing may be positioned in the carriage. As one skilled in the art will recognize, the color cartridge may include three inks, i.e., cyan, magenta and yellow inks. Alternatively, in lower cost machines, a single cartridge may be utilized wherein the three inks, i.e., cyan, magenta and yellow inks are simultaneously utilized to provide the black for text printing or for photo printing. Alternatively, a single black color cartridge may be used. During advancement, media M (FIGS. 6, 7) moves from the input tray 22 to the output tray 24 through the substantially C-shaped media feedpath 21 beneath the carriage and cartridge 23. As the media M moves into a printing zone, beneath the at least one ink cartridge, the media M moves in a first direction as depicted and the carriage and the cartridges move in a second direction which is transverse to the movement of the media M.

Referring again to FIG. 1, the scanner portion 12 generally includes an ADF scanner 13, a scanner bed 17 and a lid 14 which is hingedly connected to the scanner bed 17. Beneath the lid 14 and within the scanner bed 17 may be a transparent platen for placement and support of target or original documents for manually scanning. Along a front edge of the lid 14 is a handle 15 for opening of the lid 14 and placement of the target document on the transparent platen (not shown). Adjacent the lid 14 is an exemplary duplexing ADF scanner 13 which automatically feeds and scans stacks of documents which are normally sized, e.g. letter, legal, or A4, and suited for automatic feeding. Above the lid 14 and adjacent an opening in the ADF scanner 13 is an ADF input tray 18 which supports a stack of target media or documents for feeding through the auto-document feeder 13. Beneath the input tray 18, the upper surface of the lid 14 also functions as an output tray 19 for receiving documents fed through the ADF scanner 13.

Referring now to FIGS. 3-6, an auto-compensating mechanism 30 is depicted positioned above the input tray 22 and mounted on a drive shaft 32 which defines a pivoting location for an auto-compensating mechanism (ACM) 30. The ACM 30 comprises a housing 34 which extends from the drive shaft 32 at one end to an opposite end where at least one pick tire or drive roller 46 is located. The exemplary housing 34 is generally ovalized in shape having a depth in a third dimension wherein various components are located. However, the housing 34 may be various alternative shapes capable of housing the components described herein and capable of mounting adjacent to the media feedpath 21.

The drive shaft 32 is substantially cylindrical in shape and comprises a gear 33 at one end. The gear 33 is operably engaged with a gear train (not shown) mounted on a transmission frame 25 within the printer portion 20. The transmission frame 25 may also function as a motor mount 27 wherein a motor (not shown) may be operably engaging the transmission gear train driving the ACM 30. At a side of the printer 20 opposite the frame 25, the shaft 32 is pivotally supported for rotation by the motor and transmission gear train (not shown). The drive shaft 32 may comprise a milled portion 60 for engagement of the ACM 30. By rotating the drive shaft 32, the milled portion 60 transmits torque to the ACM 30 and gears therein. Within the housing 34, the drive shaft 32 operates an ACM drive train 36 including at least one gear mounted on the shaft 32 inside the ACM 30.

Figure 4:
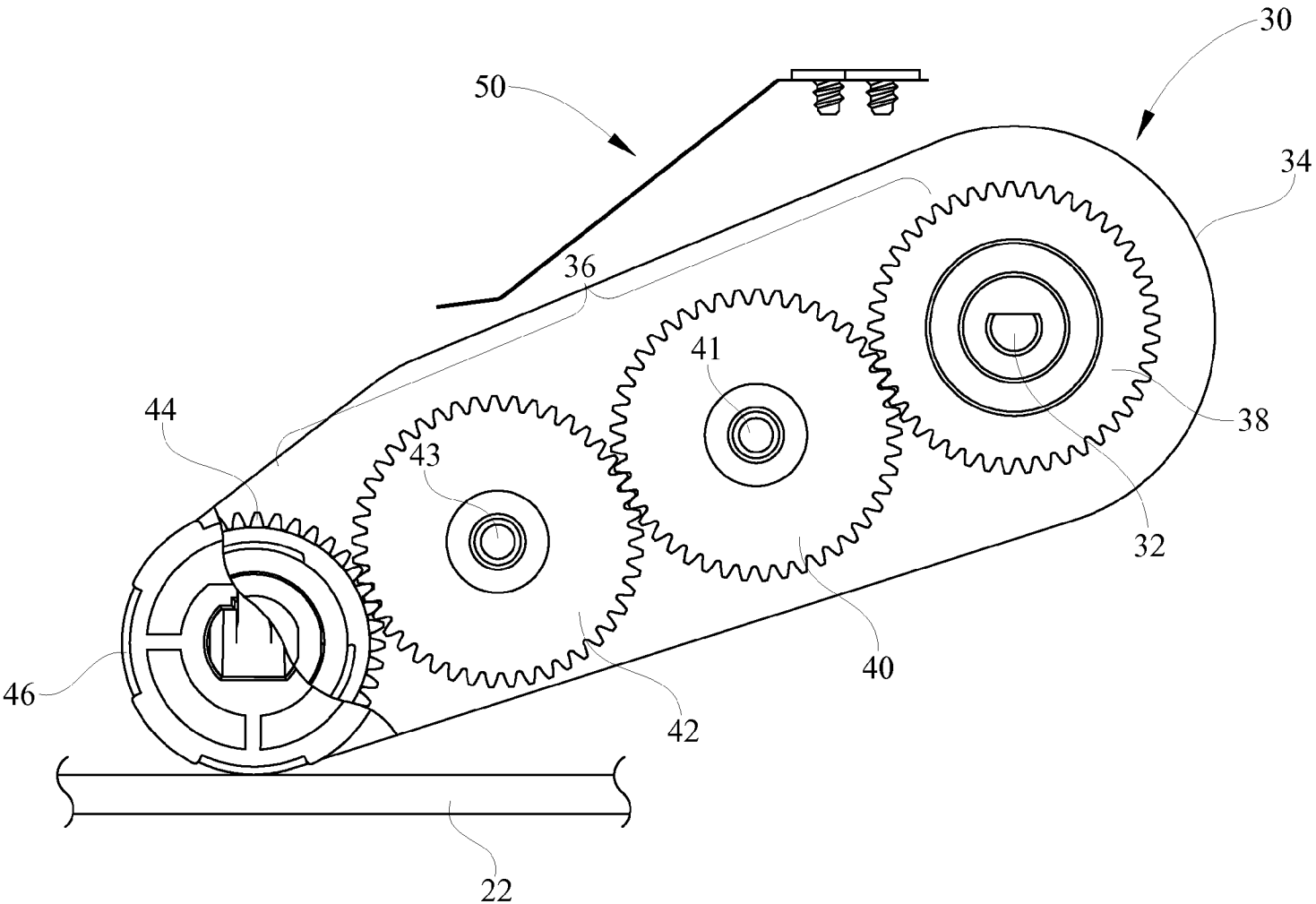
FIG. 4 is a side sectional view of the ACM with step-spring.

At a first end of the drive train 36 is a drive shaft gear 38. The drive shaft 32 extends through the drive shaft gear 38 and is engaged therewith to transmit torque from the shaft 32 to the gear 38. In turn, this causes the ACM 30 to pivot in a counter-clockwise direction (as shown in FIG. 4) about the shaft 32. With counter-clockwise rotation, the ACM 30 creates downward or normal force at the at least one pick tire 46 spaced from the shaft 32. As the ACM 30 encounters resistance from the media stack M, the normal force increases. The drive shaft gear 38 and shaft 32 may be driven by a motor directly or indirectly by a gear transmission (not shown) mounted on the transmission frame 25. One skilled in the art will understand such configuration and will be able to ascertain which system is most desirable in a given application.

Adjacent the drive shaft gear 38 is a first idle or transmission gear 40. The first transmission gear 40 rotates about a shaft 41 extending through the ACM housing 34. The shaft 41 extends generally parallel to the drive shaft 32. The first transmission gear 40 is driven by the drive shaft gear 38 and drives a second transmission gear 42. In addition to rotating about shaft 41, the first transmission gear 40 orbits about drive shaft 32 as the ACM 30 moves through a stack of media from a first angle of operation to a second angle of operation. The first transmission gear 40 may have a number of teeth which is selected by one skilled in the art based on the angular velocity of the drive shaft 32 and the desired angular velocity at the pick tire 46.

Adjacent the first transmission gear 40 is a second transmission gear 42 which also rotates about a shaft 43 extending through the ACM housing 34. The shaft 43 is also generally parallel to the drive shaft 32. The second transmission gear 42 rotates about the shaft 43 and orbits about the shaft 32 and drive shaft gear 38. The second transmission gear 42 acts as a reversing gear to provide the desired rotational direction of the pick tire 46 relative to the tray 22. The desired rotational direction is determined by the direction of media feed required to move the media into the media feed path 21. Like the first transmission gear 40, the second transmission gear 42 has a number of teeth selected based on input angular velocity of the first gear 40 and the desired angular velocity of the pick tire 46.

Adjacent the second transmission gear 42 is a drive roller gear 44 which is operably connected to the drive roller or pick tire 46. The drive roller gear 44 and pick tire 46 are coaxially disposed upon a shaft (not shown) extending through the ACM housing 34 which is parallel to the shaft 32 as well as the shafts 41,43 for the first and second transmission gears 40, 42. The gear 44 rotates about the shaft as well as orbiting about drive shaft 32. As previously indicated, the input angular velocity of gear 42 and the number of teeth of gear 44 determine the output angular velocity of the gear 44 and pick tire 46. Because this angular velocity is known based on required speed of media in the media feed path 21, the characteristics for gears 40, 42 may be calculated, as will be understood by one skilled in the art.

Disposed above the ACM 30 is a step spring or biasing member 50. The spring or biasing member 50 may be utilized to force a component to bear against, to maintain contact with, to engage, to disengage, or to remain clear of some other component. The biasing member 50 is capable of storing energy when loaded and forced in one direction by the ACM and media M there below. As the ACM 30 operated and moves in the second direction, the member 50 is unloaded until it applies no force on the ACM 30. The biasing member has the characteristic of maintaining its ability to be loaded within operating loads. The exemplary biasing member 50 is depicted as a leaf spring however various elastic bodies and shapes may be utilized and substituted for the leaf spring design. For instance, the biasing member 50 may be, for example, a flat spring, a spiral spring or a helical spring. Flat springs include, but are not limited to, elliptical leaf or half-elliptical leaf springs. The helical springs are generally formed of round cross-section wire or the like and may include a compression or tension springs, as well as torsion and cone shaped springs.

The biasing member 50 is connected at an upper end to an adjacent structure of the printer 20 (not shown for purpose of clarity). The connection may be by fastener or by unitary connection such as a weld. Alternatively, the biasing member 50 may be connected to and extend from the housing 34 at one end, while free to engage some internal printer structure at the other end.

Because the step spring 50 is positioned above the ACM housing 34, as the ACM 30 moves toward a horizontal position, the free end of the step spring 50 engages the ACM housing 34. As a result, the flexed step spring 50 places a force on the ACM 30 which is substantially constant. As the ACM 30 rotates counter-clockwise during media feed, the down force increases due to the operation of the ACM 30. As the media stack height decreases during operation, the force applied by the step spring 50 remains generally constant until the spring force is disengaged from the ACM 30.

Figure 5:
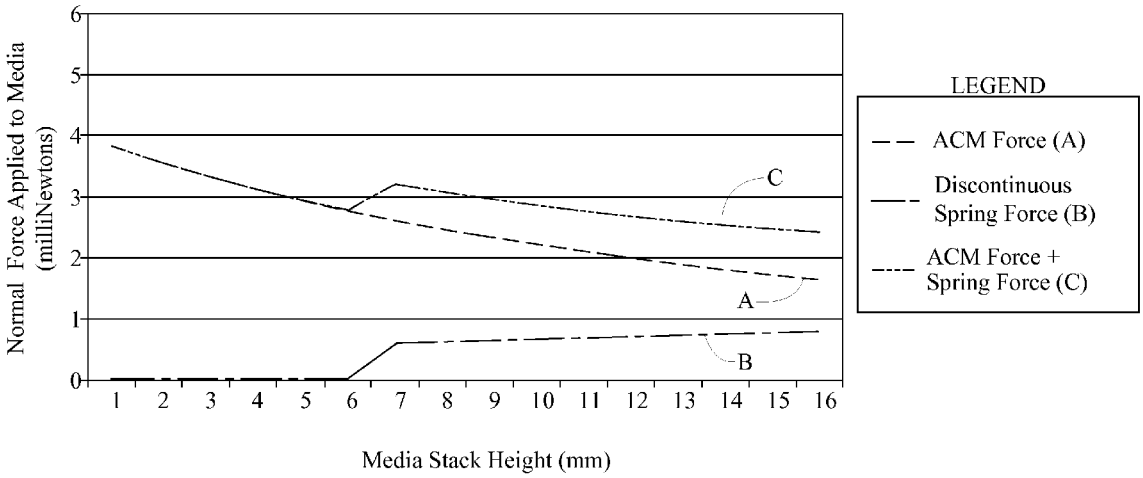
FIG. 5 is a graphical representation of the relationship between the ACM force and the height of the media stack.

Referring now to FIG. 5, a graph is depicted which compares the normal force of the ACM to the input paper stack height. Alternatively interpreted, FIG. 5 depicts a relationship between the normal force of the ACM and the angular position of the ACM 30. As previously indicated, the normal force created by an ACM is less when the ACM is disposed in a substantially horizontal position. However, the ACM 30 utilizes a step spring 50 to increase the down force when the media stack M is high so that the down force is within a desirable operating range and so that media with high coefficients of friction may be picked.

As depicted, line A depicts the normal force created by the ACM 30 without a step spring. During operation, the down force is greatest when the media stack is low. As the media stack M decreases in height, during media feeding, the torque increases such that additional spring force is not necessary. The media height is related to the position of the ACM 30 because the ACM 30 is close to a horizontal position when the media stack is high and angled from the horizontal as the height decreases during media feeding.

Beneath line A, line B depicts the force created by the step spring. The force is zero until the media height reaches a pre-selected position. In the present example, the paper height must reach six millimeters (6 mm) for the step spring 50 to engage. Once engaged, the step spring 50 increases its force on the ACM 30 until the height reaches another preselected height, for example about seven millimeters (7 mm) where the force becomes substantially constant. Between 6 mm and 7 mm, the spring 50 is loaded by engagement between the printer frame and ACM 30. Although these dimensions are provided, one skilled in the art should realize that these dimensions may vary based on the tray 22 capacity and position of the ACM relative to the tray 22. The spring force is discontinuous since at certain positions no force is applied by the spring 50 while at other positions the spring 50 does apply force to the ACM 30 thereby increasing the normal force applied by the ACM 30 to the media stack M.

Line C represents a summation of the normal force created by the ACM 30 and the step spring 50. The normal force is greatest at the end of the chart where the input paper stack is at its lowest. This is because the down force applied by the ACM 30 is high although the force applied by the spring 50 is zero. As the media stack height increases, the down force decreases until a jump in down force is exhibited around the six millimeter (6 mm) stack height, corresponding to Line B. As the media stack height increases, the normal force applied by the ACM 30 decreases but the force is higher than that force of Line A because of the increase in force caused by spring 50. The increase in down force of spring 50 maintains the total down force (spring 50+ACM 30) within a preselected operating range. According to the present exemplary embodiment, a range of operation for the normal force may be between 2 and 4 milli-Newtons. Although this may vary depending on the characteristics previously described. Further, since the spring 50 force is generally constant, curvature of Line C is generally parallel to Line A. At a position where the normal force would normally be outside its range of operation, the spring force of the step spring 50 increases the total normal force applied to the media so that the apparatus provides a normal force within an operable range even though the media stack continues to increase in height. Through this increase in normal force, the ACM 30 is kept within an operating range which is desirable and useful for various types of media.

Operation of the device is now described. Referring to FIG. 6, a side view of the ACM 30 is depicted in the printer 20 disposed above a media input tray 22 having a full media stack M therein. The stack height corresponds to a height which is along the right side of the chart of FIG. 5 so that the biasing member 50 is fully loaded. The ACM 30 is disposed in a substantially horizontal position due to the height of the media stack M. The horizontal position causes the spring 50 to be flexed against the ACM 30 and impart a down force on the ACM 30. The step spring 50 imparts a maximum force when the tray 22 is completely filled with media M.

As drive shaft 32 rotates in a counter-clockwise direction, gears 40 and 42 rotate in their respectively proper directions so that the gear 44 and pick tire 46 turn in a clockwise direction for media feeding. Rotation of the drive shaft 32 causes the ACM 30 to create a down force until the upper sheet of media slips relative to the second sheet. When this slip occurs, the down force of the ACM 30 relaxes and a sheet of media is fed. In combination with the ACM 30, the biasing member 50 maintains enough down force on the ACM 30 from its horizontal position through a preselected angular position to keep the media feed operating properly.

Referring now to FIG. 7, the ACM 30 is again depicted after feeding some of the media stack M such that the angular position of the ACM 30 has changed. As compared to FIG. 6, the ACM of FIG. 7 has rotated downwardly, in a counter-clockwise direction from a substantially horizontal position to a position disposed away from the horizontal such that the spring 50 is not engaging the ACM 30. In this position, as opposed to FIG. 6, the normal force of the ACM 30 is sufficient so not to require the spring 50. Therefore, the spring 50 is discontinued from applying force to the ACM 30. The position of the ACM in FIG. 7 corresponds to the right hand side of the chart in FIG. 5. In terms of angular displacement, the biasing element 50 may engage the ACM 30 from a horizontal position through about twenty degrees (20°) from the horizontal. Below this angular position, the biasing member 50 disengages the ACM 30.

Figure 8:
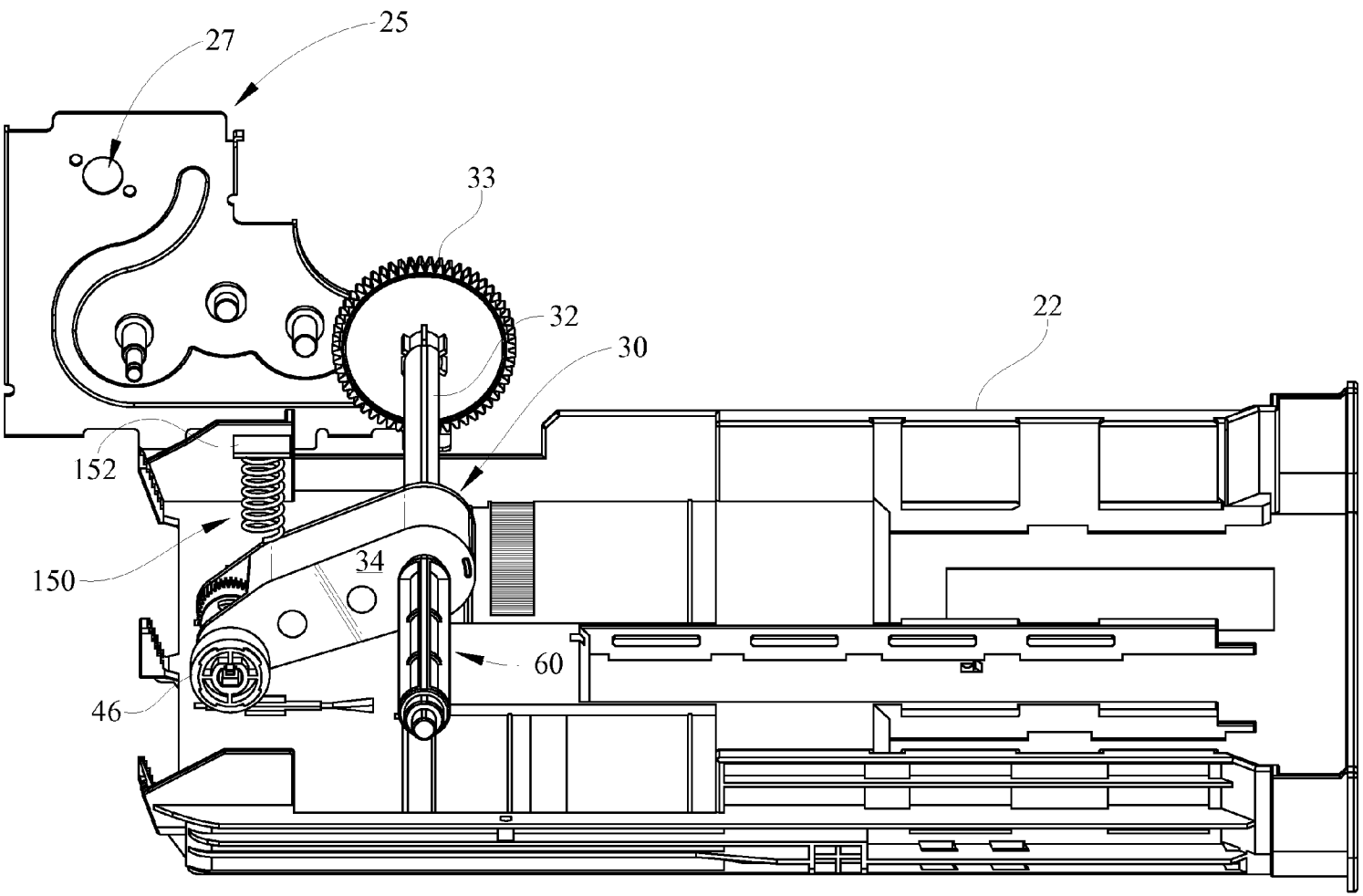
FIG. 8 is a perspective view of an alternate embodiment of the biasing element.
Figure 9:
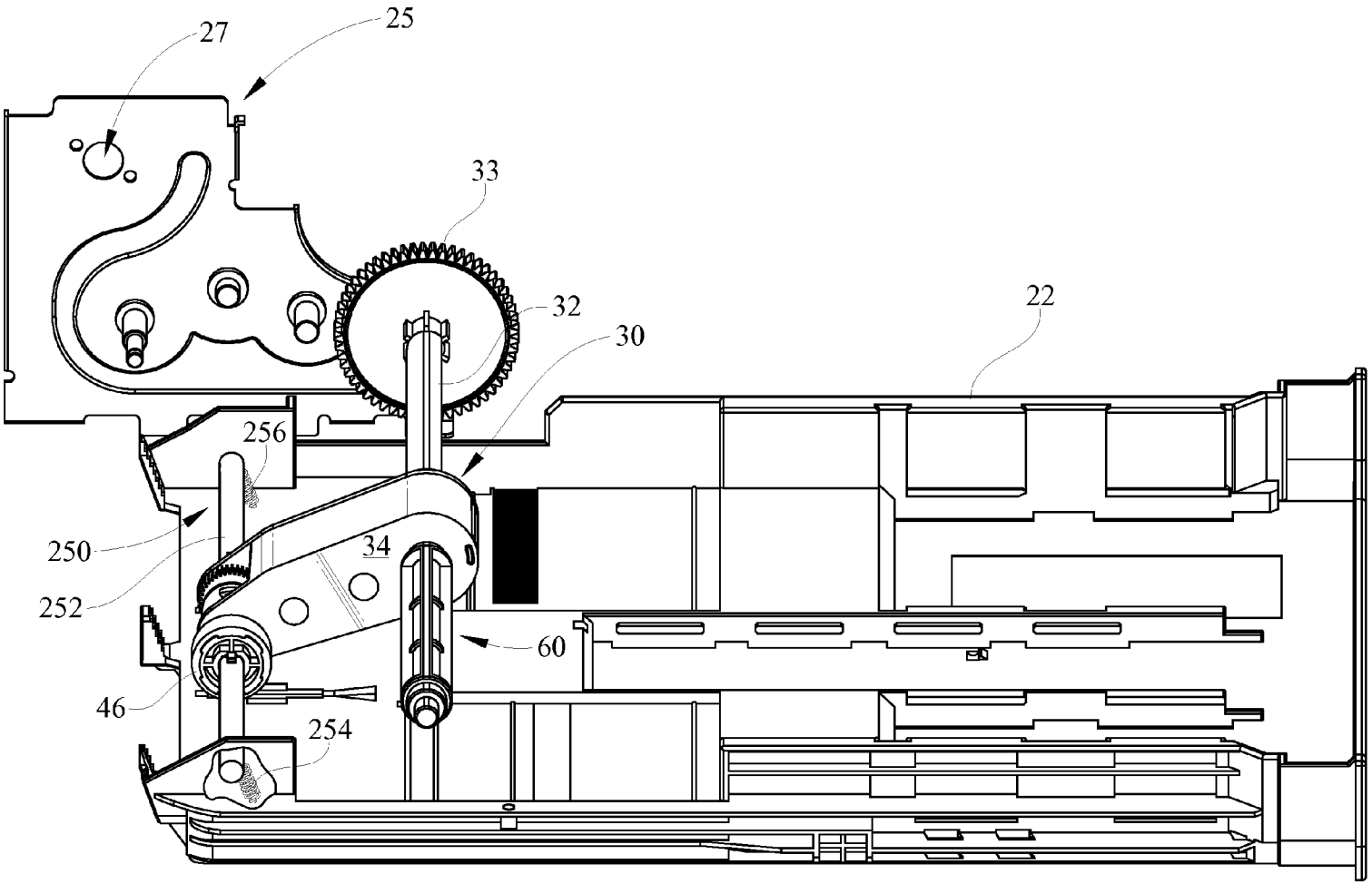
FIG. 9 is a perspective view of an alternate embodiment of the biasing element; and, FIG. 10 is a perspective view of an alternate embodiment of the biasing element.
Figure 10:
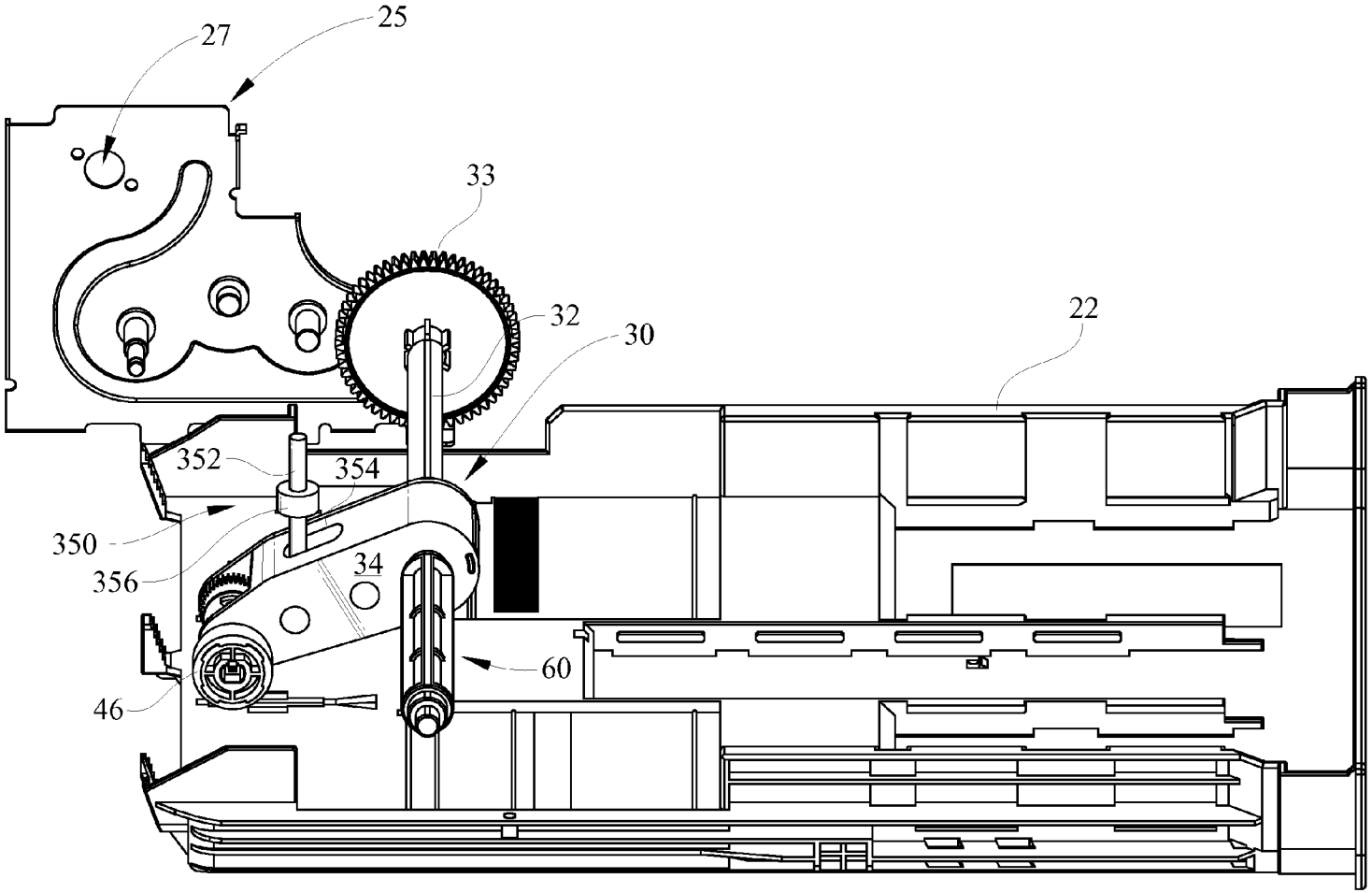

Referring now to FIGS. 8-10, various alternative embodiments are depicted utilizing biasing elements or members to place a discontinuous force on the ACM 30. FIG. 8 depicts a perspective view of the media tray 22 with the ACM 30 disposed above one end of the tray. According to the embodiment depicted, a biasing element 150 is shown as a coil spring rather than a leaf spring as described in the previous exemplary embodiment. The coil spring is shown in a neutral, unflexed position with the ACM 30 disposed against the lower media support surface of the media tray 22. When a media stack is inserted into the media tray 22, the ACM 30 pivots about the drive shaft 32 upwardly towards a horizontal position with the media below the ACM. As the ACM reaches a pre-selected angular position, the coil spring 150 is engaged and places a down force on the ACM 30. The coil spring 150 is depicted as depending from a print structure which is depicted as a flat plate 152, which may represent, for example, the mid-frame of the printer, and is free at a lower end. However, one skilled in the art may realize that the coil spring 150 may be connected to the ACM 30 at a lower end while being free to move into engagement with the mid-frame or other structure at the upper end, in a configuration which is opposite that depicted in FIG. 8.

Referring now to FIG. 9, a second alternative embodiment of the step spring assembly 250 is depicted. According to the embodiment shown, an assembly 250 is provided comprising a shaft 252 extending through a movable end of the ACM 30. The shaft 252 extends through the ACM 30 at or around the axis of the at least one pick tire 46. The movable end of the ACM 30 moves through various elevations as the ACM 30 pivots about the shaft 32 and moves through its angular range of displacement. A shaft 252 extends generally across the media tray 22 and is connected to extension springs 254, 256 generally at ends thereof. The extension springs are shown in a substantially neutral position with the ACM 30 in a down position due to the media tray 22 being empty. When a stack of media is loaded into the media tray for printing, the ACM 30 pivots about the shaft 32 toward a generally horizontal position. As the ACM 30 reaches a pre-selected position moving upward towards a horizontal position, the extension springs 254, 256 move from the neutral unflexed position into a flexed position due to upward movement of the shaft 252 with the ACM 30. Thus, when the media tray 22 comprises a stack of media, the ACM 30 pivots to a position where the extension springs 254, 256 place a discontinuous down force on the ACM 30. As the media stack feeds into the peripheral, the ACM 30 moves downwardly and reaches a position where the springs 254, 256 are no longer placing a down force on the ACM 30. Thus the force of the springs 254, 256 are discontinuous. Although two springs are depicted in the embodiment of FIG. 9, a single shaft which extends from one side of the ACM 30 as well as a single spring connected to that shaft may alternatively be utilized and is well within the scope of the described embodiment.

Referring now to FIG. 10, a third alternative embodiment is depicted. A biasing assembly 350 is depicted having a rod 352 extending through the ACM 30. The rod 352 may depend from the printer mid-frame (not shown) and extend some pre-selected length such that the rod 352 does not interfere with feeding of a media stack from the media tray 22. The ACM 30 comprises an elongated aperture 354 which allows the ACM 30 to move over the rod 352 during media feeding. As depicted, the media tray 22 is empty so that the ACM 30 is in a downward most position. When a media stack is inserted into the tray 22, the ACM 30 pivots about the drive shaft 32 so that the ACM 30 moves upwardly along the rod 352. At a pre-selected position, before the ACM is disposed in a horizontal orientation, the ACM 30 engages a weight 356 which is slideably positioned on the rod 352. The weight 356 is supported in a preselected position relative to the rod 352 so that the ACM 30 is not affected by the weight until the ACM 30 reaches a specific height which is related to a full media stack being positioned in the tray 22. Thus, as the ACM 30 operates to feed media into the printer, the ACM is loaded with a force of the weight 356 from the uppermost ACM position to a preselected angular position beneath the horizontal. For example, the angular range wherein the weight 356 is engaging the ACM 30 may be about 20 degrees. Once the ACM 30 reaches this lowermost position, the weight 356 is supported by ribs, protrusions, or the like extending from the rod 352 and the ACM 30 continues to feed the media without the force of the weight 356.

In operation of the various embodiments depicted, one skilled in the art should understand that the media stack M is loaded into the media tray 22 causing the ACM 30 to rise to near an initial horizontal position. From this horizontal position or thereabouts, the discontinuous force is applied to the ACM 30 by the biasing element, for example, 50. As the media begins feeding, the ACM 30 moves from the initial position through an angular range to preselected position where the force on the ACM 30 is discontinued. Beyond the preselected position where the force is discontinued, and as the media continues to feed, the only down force is created by the torque of the drive shaft 32. When the media tray 22 is empty, a new stack of media is positioned in the tray 22 so that the ACM 30 rises to near a horizontal position and the discontinuous force is reapplied to the ACM 30.

The foregoing description of several embodiments and method of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A media pick assembly comprising:

a media tray for retaining a stack of media in a peripheral;

an auto-compensating mechanism disposed adjacent to said media tray, said auto-compensating mechanism movable through an operating range including a starting angular position and an ending angular position; and, a media biasing member engaging said auto-compensating mechanism, said media biasing member providing a discontinuous force on said auto-compensating mechanism when said stack of media is above a preselected height and discontinuing applying said discontinuous force on said auto-compensating mechanism when said media stack decreases to said preselected height.

2. The assembly of claim 1 wherein said discontinuous force is acting on said auto-compensating mechanism based on the preselected height and the angular position of said auto-compensating mechanism.

3. The assembly of claim 2 wherein said biasing member disengages said auto-compensating mechanism at a preselected position.

4. The assembly of claim 1 wherein said discontinuous force is applied in a limited portion of said operating range corresponding to a height of said stack of media in said media tray.

5. The assembly of claim 1 wherein said operating range is between about 0 degrees and about 25 degrees.

6. The assembly of claim 1 wherein said biasing member is a leaf spring.

7. The assembly of claim 1 wherein said biasing member is a coil spring.

8. The assembly of claim 1 wherein a total down force by said auto-compensating mechanism and said discontinuous force by said biasing member is between about 2 and 4 millinewtons.

9. The assembly of claim 1 wherein one end of said biasing member is connected to a structure inside of said peripheral.

10. The assembly of claim 1 wherein one end of said biasing member is connected to said auto-compensating mechanism.

11. A media pick assembly, comprising:

a printer;

an auto-compensating mechanism within said printer which transmits torque to a media pick tire, said auto-compensating mechanism increasing down force on a media stack during operation through a preselected angular range; and a biasing member having a first end and a second end, said first end engaging a stationary part of said printer, said second end engaging said auto-compensating mechanism by applying a discontinuous force to said auto-compensating mechanism when said stack of media is above a preselected height and discontinuing applying said discontinuous force on said auto-compensating mechanism when said media stack decreases to said preselected height through a limited portion of said preselected angular range.

12. The media pick assembly of claim 11 wherein said auto-compensating mechanism moves from a substantially horizontal position downward to a lower limit during said preselected angular range.

13. The media pick assembly of claim 11 wherein said auto-compensating mechanism creates a down force which is proportional to resistance created between media sheets, said down force being greater when said media stack is low than when said media stack is high.

14. The media pick assembly of claim 13 wherein said biasing member engages said auto-compensating mechanism when said media stack is high to increase down force in said limited portion of said preselected angular range.

15. The media pick assembly of claim 11 wherein said biasing member is connected to said auto-compensating mechanism.

16. The media pick assembly of claim 11 wherein said biasing member is connected to an internal portion of said printer.

17. A media pick biasing assembly for a peripheral having an auto-compensating mechanism, comprising:

an auto-compensating mechanism rotatably connected to a drive shaft, said auto-compensating mechanism having a range of motion associated with feeding of media from a media tray in said peripheral;

a biasing member applying a force on said auto-compensating mechanism when said stack of media is above a preselected height and discontinuing applying said force on said auto-compensating mechanism when said media stack decreases to said preselected height through a preselected angular range of motion of said auto-compensating mechanism, said biasing member connected to said peripheral and engaging said auto-compensating mechanism.

18. The assembly of claim 17, said auto-compensating mechanism moving from a first position to a second position.

19. The assembly of claim 18, said biasing member engaging said auto-compensating mechanism within said preselected range of motion between said first position and said second position.

20. The assembly of claim 19 wherein said preselected range of motion is about 0 degrees to about 25 degrees.

21. The assembly of claim 17 said biasing member is one of a leaf spring and a coil spring.

22. The assembly of claim 17 wherein said biasing member creates additional downward force for said auto-compensating mechanism within said preselected range.

23. The assembly of claim 22 wherein said additional downward force is inhibited outside said preselected angular range.

24. A method of adjusting force on an auto-compensating device of a media feeding apparatus, comprising:

feeding media from a media stack into a peripheral with said auto-compensating device;

applying a discontinuous force on said auto-compensating mechanism when said media stack is above a preselected height; and discontinuing applying said discontinuous force on said auto-compensating mechanism when said media stack decreases to said preselected height during feeding of said media.

* * * * *